United States Patent [19]

Edamura et al.

[11] 4,336,076

[45] Jun. 22, 1982

[54] METHOD FOR MANUFACTURING ENGINE CYLINDER BLOCK

[75] Inventors: Mizuo Edamura, Kobe; Shyunji Takamoto, Akashi; Satoshi Furuitsu, Kakogawa; Norikatsu Bekku, Takarazuki; Toshiaki Katayama, Yokohama, all of Japan

[73] Assignee: Kawasaki Jukogyo Kabushiki Kaisha, Kobe, Japan

[21] Appl. No.: 149,689

[22] Filed: May 14, 1980

Related U.S. Application Data

[62] Division of Ser. No. 887,379, Mar. 16, 1978, abandoned.

[30] Foreign Application Priority Data

Mar. 17, 1977 [JP] Japan ..... 52-29590

[51] Int. Cl.[3] ..... C22F 1/04

[52] U.S. Cl. ..... 148/3; 148/13; 148/159; 148/436

[58] Field of Search ..... 148/3, 13, 159, 32, 148/32.5; 75/142

[56] References Cited

U.S. PATENT DOCUMENTS

| | | | |
|---|---|---|---|
| 1,799,837 | 4/1931 | Archer et al. | 75/142 |
| 1,924,726 | 8/1933 | Rowe | 75/142 |
| 4,055,417 | 10/1977 | Komiyama et al. | 75/142 |

*Primary Examiner*—R. Dean

*Attorney, Agent, or Firm*—Fleit & Jacobson

[57] ABSTRACT

Engine cylinder block made of an aluminum alloy containing in weight 4 to 14% of Si, 1 to 5% of Cu and 0.2 to 0.8% of Mg. Method for manufacturing the cylinder block includes a heat treatment step after moulding of such aluminum alloy.

5 Claims, 2 Drawing Figures

METHOD FOR MANUFACTURING ENGINE CYLINDER BLOCK

Figure 1:
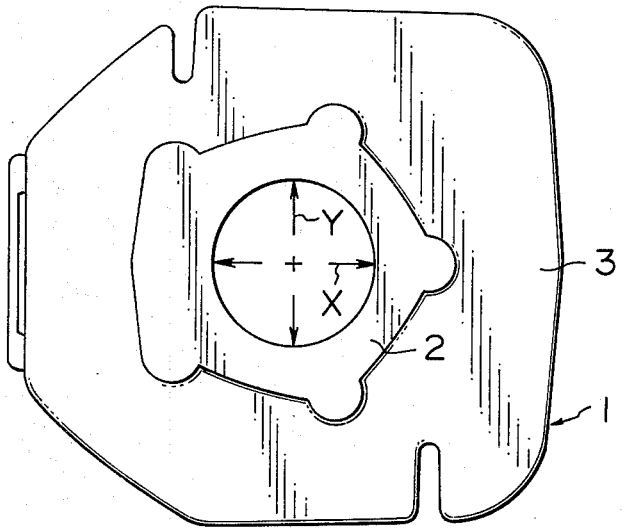

This is a divisional of application Ser. No. 887,379 filed Mar. 16, 1978, now abandoned.

The present invention relates to engine cylinder blocks and a method for manufacturing the same. More particularly, the present invention pertains to engine cylinder blocks which are made of an aluminum alloy and have superior dimensional stability under a high temperature, and also to a method for manufacturing the same.

In general, known types of aluminum alloys for use in manufacture of engine cylinders include so-called Lo-Ex alloy which has a low coefficient of thermal expansion under a high temperature and contains in weight 0.8 to 4.0% of Cu, 8.5 to 13.0% of Si, 0.6 to 1.5% of Mg and 0.2 to 2.5% of Ni, as well as so-called 390 alloy which contains in weight 4.0 to 5.0% of Cu, 16.0 to 18.0% of Si and 0.45 to 0.65% of Mg. Particularly, a wide use is made of so-called Lautal alloy which essentially contains in weight 2.0 to 4.0% of Cu and 4.0 to 10.0% of Si and possesses a superior moulding property and an excellent mechanical property under a high temperature.

It has been experienced, however, that moulded parts of such aluminum alloys undergo dimensional changes when they are maintained under a high temperature for a prolonged time. This is understood as being caused by a "growing phenomenon" in that solutes which have been contained in super-saturated condition in solid solutions are educed and cause changes in the internal structures. Whereas engine cylinder blocks are subjected to a high temperature for a prolonged time due to the fact that a substantial amount of heat is produced in the cylinders in their use through combustion of air-fuel mixtures or reciprocating movements of the pistons in the cylinders, the engine cylinder blocks undergo, when they are manufactured by moulding such aluminum alloys, dimensional changes of as large as 0.1 to 0.15% due to the growing phenomenon which occurs in use of the engines.

Hithertofore, in order to eliminate the aforementioned problem, it has been proposed and already put into practice to apply a heat treatment to the engine cylinder blocks as moulded by the aluminum alloys. Such heat treatment has been found as being effective to suppress the growth of the cylinder block materials, however, it has been found that there still exists a certain amount of, for example 0.1% of growth. Therefore, there still is a demand for suppressing the growth of the cylinder block materials after moulding thereof.

More specifically, when it is intended to use the aluminum alloy as exposed to the cylinder bore surface or covered by a coating which is formed through a plating or a wire-explosion coating process, any dimensional change due to the growth of the aluminum alloy directly causes a change in the cylinder bore diameter. For example, in case of an aluminum alloy cylinder having a bore diameter of 56 mm, a material growth of 0.1% causes an increase in the bore diameter of 56 microns. Thus, when the engine is so designed that there is a nominal clearance of 100 microns between the cylinder wall and the piston, the clearance will be increased as large as 156 microns and there will be troubles in engine operation, such as an increased leakage of gas and chattering of piston.

It is therefore an object of the present invention to provide an engine cylinder block which is made of an aluminum alloy having a superior dimensional stability.

Another object of the present invention is to provide a method for manufacturing an engine cylinder block which does not undergo any significant dimensional change under a high temperature.

A further object of the present invention is to provide an engine cylinder block which is made of a Lautal alloy added with an element for improving the dimensional stability.

The present invention is based on the inventor's finding that the amount of growth can be substantially decreased when the Lautal alloy is added with a certain amount of magnesium. More particularly, it has been found that the growth can be maintained below 0.01% even when the cylinder block is maintained under a high temperature when the cylinder is applied with a heat treatment after moulding.

Thus, the above and other objects of the present invention can be accomplished by an engine cylinder block made of an aluminum alloy containing in weight 4 to 14% of Si, 1 to 5% of Cu and 0.2 to 0.8% of Mg. Further, there is also provided a method for manufacturing an engine cylinder block in accordance with the present invention which comprises steps of moulding an aluminum alloy containing in weight 4 to 14% of Si, 1 to 5% of Cu and 0.2 to 0.8% of Mg to form a blank of the cylinder block and subjecting the moulding blank to a heat treatment.

The present invention will further be described in detail. As described, the engine cylinder block in accordance with the present invention is made of an aluminum alloy containing in weight 4 to 14% of Si, 1 to 5% of Cu and 0.2 to 0.8% of Mg. The silicon contained in the alloy by an amount of 4 to 14% in weight serves to improve the castability of the alloy. With the silicon content less than 4%, there will be no effective improvement in the castability while with the silicon content greater than 14% there will be a tendency that the silicon is educed in the initial crystalline structure resulting in a decrease in the mechanical strength.

The copper content serves to improve the aging property of the alloy and as a consequence increase the mechanical strength. Where the copper content is insufficient, a desired improvement cannot be obtained. However, excessive amount of copper will cause hot tear cracks after moulding. Thus, it is recommended to maintain the amount of copper between 1 and 5%, preferably 2 and 4%.

Magnesium serves to suppress the growth of the alloy and at the same time improve the mechanical and cutting properties of the alloy. Significant effect can be obtained in suppressing the growth of material through the addition of magnesium particularly when the moulded cylinder blocks are subjected to heat treatment. An adequate improvement cannot be obtained with an insufficient amount of magnesium. Further, the effect of improvement will no more occur when the magnesium is added to an excessive amount. Thus, it is recommended to maintain the amount of magnesium between 0.2 and 0.8%, preferably between 0.4 and 0.6%.

The engine cylinder block in accordance with the present invention is thus made of an aluminum alloy containing, as essential elements, silicon, copper and magnesium, however, it should be noted that the aluminum alloy may be added with one or more of other elements such as nickel, manganese, titanium and boron in order to obtain desired properties.

Nickel serves to improve the mechanical strength of the cylinder block under a high temperature and may be contained by an amount of 0.5 to 2.5% in weight, preferably 0.5 to 1.5%. Where the magnesium content is relatively small, for example, between 0.2 and 0.4% in weight, the nickel content may serve to suppress the growth of the cylinder material. Insufficient nickel content cannot provide a desired effect but an excessive amount of nickel content has an adverse effect on the toughness of the alloy. Thus, the above range of nickel content is recommended in the cylinder block of the present invention.

Manganese serves, when added to the alloy, to increase the mechanical strength of the alloy under a high temperature. Insufficient amount of manganese has no effect of improvement, however, when it is added excessively, it has an adverse effect on the toughness of the alloy and at the same time increases the melting point. Thus, according to the present invention, the amount of manganese is between 0.5 and 2.0%, preferably between 0.7 and 1.3% both in weight.

The alloy further inherently contains iron as an impurity and, when the iron impurity is excessively contained, there will be formed intermetallic compounds such as Al-Fe-Si resulting in decrease in the elongation and the impact resistance of the alloy. Therefore, it is preferable to maintain the iron content below 0.5% in weight. Where manganese is added to the alloy as described above, the iron content may be as large as 1.0% in weight because the manganese has an effect of suppressing the formation of the intermetallic compounds.

Titanium is known as being effective in producing minute crystalline grains in the alloy and therefore serves to increase the mechanical strength. Thus, it may be added to the alloy by the amount between 0.05 and 0.2% in weight. With the titanium content less than 0.05%, no desired effect will be obtained, however, if it is added beyond 0.2%, there will be a decrease in the mechanical strengths, particularly in the elongation and the impact resistance.

Boron serves to enhance the effect of the titanium when it is added to the alloy in an amount 1/20 to 1/5 of the titanium content. Further, boron is effective in decreasing the shrinkage in moulding operation.

In accordance with the present invention, an engine cylinder block is manufactured by moulding an aluminum alloy which contains silicon, copper and magnesium, and may optionally contain nickel, manganese, titanium and boron as described above. Conventional moulding process or die-casting technique may be employed for the purpose. When a conventional moulding process is employed, the aluminum alloy is poured in a molten form under 680° to 750° C. into a mould which is preheated to a temperature between 150° and 300° C. and then cooled down to obtain a moulded cylinder block. In pouring the molten alloy into the mould, it is preferable to force the molten alloy through a conduit under a pressure of 0.1 to 0.8 kg/cm$^2$. By applying such a small pressure to the molten alloy, it is possible to introduce the alloy rapidly and quietly into the mould cavity so that the mould cavity can be filled rapidly with the molten alloy.

When the die-casting technique is employed, the aluminum alloy is instantaneously poured in a molten form under 600° to 700° C. into the mould cavity under a pressure of 300 to 2000 kg/cm$^2$. In this instance, it is preferable to add 0.5 to 2.0% in weight of iron to the alloy in order to prevent the moulded part from adhering to the mould.

The moulded part is then subjected to a heat treatment through which the moulded part is relieved of residual stress and aging is proceeded to provide an improved mechanical property. According to the present invention, it should particularly be noted that the heat treatment contributes, in combination of the magnesium additive, to suppressing of growth of the moulded material.

For the purpose of heat treatment, the moulded part may be maintained under a treatment of 200° to 400° C. for 1 to 10 hours and then cooled down. Alternatively, it may be maintained under a temperature of 480° to 550° C. for 4 to 12 hours, cooled down to a temperature of 15° to 80° C. with a rate of cooling of 3° to 10° C./sec., then maintained under a temperature of 200° to 300° C. for 2 to 8 hours and thereafter cooled down. The former heat treatment process may be called as $T_2$ (annealing) or $T_5$ (stabilizing) treatment while the latter is called as $T_7$ (solution treatment and stabilizing) treatment.

In the aforementioned heat treatment, it will not be possible to obtain a desired effect of suppressing the growth of the moulded material if the temperature and time are not sufficient. However, if the temperature is excessively high and/or the time for the heat treatment is excessively long, the moulded part may become too weak.

After the heat treatment, the moulded part is subjected to further treatments as desired to form a cylinder block. For example, the moulded part may be suitably machined, then covered at the inner cylinder wall with an appropriate metal coating through, for example, a wire-explosion spray process such as the one disclosed by the U.S. Pat. No. 4,044,217 to Ohtsuki et al, and thereafter ground at the coating surface.

Specifically speaking, the wire-explosion process may be performed by using a wire of coating material which has a diameter of 1 to 2 mm and is disposed in the cylinder bore of the moulded part with its length in parallel with the axis of the cylinder bore. The cylinder bore may in advance be machined to possess a radius which is larger than a desired value by for example 70 microns. A high voltage of for example 10 KV is applied to the wire so that the wire material is explosively dispersed or sprayed onto the wall surface of the cylinder bore. Where the cylinder block is made of aluminum alloy, wires of molybdenum and steel are alternately used to provide a coating of desired property.

For example, the cylinder bore wall is at first coated with molybdenum and then with steel and thereafter alternately with molybdenum and steel to form a layer comprised of molybdenum and steel. For example, the alternate spraying of molybdenum and steel may be repeated 18 cycles to form a coating layer of 150 microns thick. After such wire explosion spray process, the coating surface is appropriately ground to form a cylinder bore of desired radius. It has well been recognized that the coating thus formed provides a sliding surface of superior wear-resistant and lubricating properties.

Thus, it will be noted that the present invention provides an engine cylinder block having a superior dimensional stability. The present invention will now be described with reference to specific examples taking also reference to the accompanying drawings, however, it should be noted that the invention is not limited to the details of such example.

Figure 2:
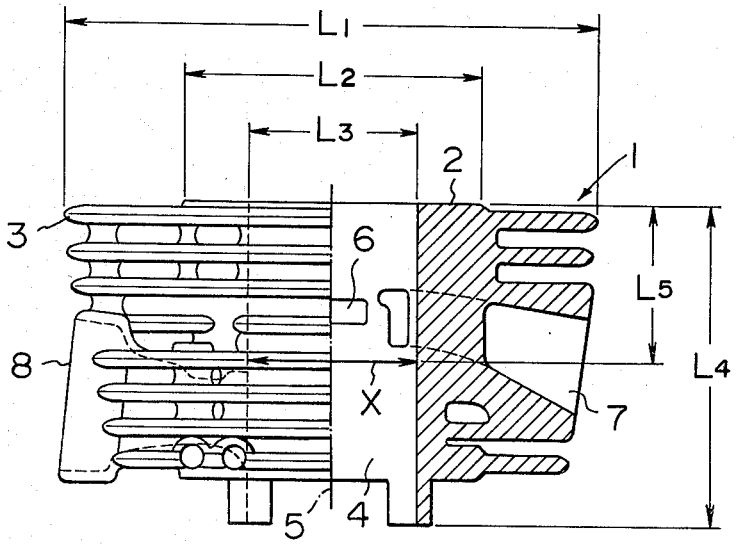

In the drawings:

FIG. 1 is a plan view of a cylinder block to which the present invention can be applied; and FIG. 2 is a side view of the cylinder block.

Referring to the drawings, the engine cylinder block 1 has a flat top surface 2 and cooling fins 3. Further, the cylinder block 1 is formed with a cylinder bore 4 having a central axis 5. As conventional in the art, the cylinder block 1 is formed with scavenging ports 6, an exhaust port 7 and an intake port 8. Several dimensions are shown by characters $L_1$ through $L_5$ to assist the descriptions of examples.

EXAMPLES

Alloys having compositions as shown in Table 1 were molten in crucibles. The molten alloys were then moulded at a temperature of 700° C. and cooled down to form cylinder blocks for air-cooled, two stroke engines as shown in FIGS. 1 and 2. The initial dimensions of the cylinder blocks were as follows:

$L_1$=180 mm
$L_2$=100 mm
$L_3$=156 mm
$L_4$=110 mm

The samples 2 and 4 were subjected to $T_5$ stabilizing treatment in which the cylinder blocks were maintained under 200° C. for six hours and then air-cooled. The samples 1 and 3 were not subjected to any heat treatment. The samples were then subjected to repeated heating. More specifically, the cylinder blocks under normal temperature (20° C.) were put in a furnace having a temperature of 300° C. for six hours and laid under normal temperature for sixteen hours. Then, the cylinders were put under the furnace temperature of 300° C. for three hours and laid under normal temperature for sixteen hours. Thereafter, the cylinders were subjected to repeated cycles of heating to 300° C. for three hours and laying them under normal temperature for sixteen hours.

TABLE 1

| | Si | Cu | Mg | Fe | Ti | Heat Treatment |
|---|---|---|---|---|---|---|
| Sample 1 | 8.9 | 3.5 | 0.47 | 0.16 | 0.15 | — |
| Sample 2 | 8.9 | 3.5 | 0.47 | 0.16 | 0.15 | $T_5$ |
| Sample 3 (Prior Art) | 8.5 | 2.9 | — | 0.15 | 0.15 | — |
| Sample 4 (Prior Art) | 8.5 | 2.9 | — | 0.15 | 0.15 | $T_5$ |

The cylinder bore diameters were measured prior to heating and after laying for fifteen hours under normal temperature after heating. The deviations from the initial dimensions are shown in Table 2. The bore diameters were measured at locations 55 mm below ($L_5$=55) top faces 2 of the cylinder blocks as shown in FIG. 2 in two perpendicular directions which were designated as X and Y in FIG. 1.

TABLE 2

| | | Before Heating | After 1st Heat | After 2nd Heat | After 3rd Heat | After 4th Heat |
|---|---|---|---|---|---|---|
| Sample 1 | X | O | 32 | 35 | 35 | 33 |
| | Y | O | 41 | 43 | 44 | 42 |
| Sample 2 | X | O | 4 | 5 | 4 | 2 |
| | Y | O | 4 | 3 | 3 | 1 |
| Sample 3 | X | O | 39 | 39 | 38 | 35 |

TABLE 2-continued

| | | Before Heating | After 1st Heat | After 2nd Heat | After 3rd Heat | After 4th Heat |
|---|---|---|---|---|---|---|
| (Prior Art) | Y | O | 50 | 52 | 52 | 50 |
| Sample 4 | X | O | 32 | 30 | 31 | 30 |
| (Prior Art) | Y | O | 40 | 38 | 37 | 37 |

In the Table 2, it will be noted that magnesium added to the alloy is effective to suppress the growth of the cylinder material and the effect is particularly significant when the cylinder blocks are subjected to heat treatments.

Reference Tests

Aluminum alloys having compositions as shown in Table 3 were moulded under melt temperature of 700° C. to form test pieces of 10 mm in diameter and 150 mm in length. The samples 2, 5, 8 and 11 were subjected to $T_5$ stabilizing treatment in which the samples were maintained under 200° C. for six hours and then air-cooled. The samples 3, 6, 9 and 12 were subjected to $T_7$ treatment in which they were applied with solution heat treatment by maintaining them under 500° C. for eight hours, then water quenched and thereafter maintained under 220° C. for six hours and cooled down by air. The samples 1, 4, 7 and 10 were not applied any heat treatment.

The samples were then maintained under 250° C. for sixty-four hours and cooled by air. The dimensions of the samples were measured before heating and after fifteen hours from air-cooling. The dimensional growths of the samples were calculated in accordance with the following equation and shown in Table 3.

$$\text{Dimensional Growth (\%)} = \frac{l_t - l_o}{l_o} \times 100$$

where:

$l_o$ is the length of the test piece before heating; and $l_t$ is the length of the test piece after heating, air-cooling and maintaining under room temperature for fifteen hours.

TABLE 3

| Sample | Composition (% weight) Si | Cu | Mg | Fe | Ni | Ti | Heat Treatment | Growth (%) |
|---|---|---|---|---|---|---|---|---|
| 1 | | | | | | | — | 0.110 |
| 2 | 8.5 | 2.9 | — | 0.15 | — | 0.15 | $T_5$ | 0.067 |
| 3 | | | | | | | $T_7$ | 0.049 |
| 4 | | | | | | | — | 0.089 |
| 5 | 8.9 | 3.5 | 0.47 | 0.16 | — | 0.15 | $T_5$ | 0.003 |
| 6 | | | | | | | $T_7$ | 0.009 |
| 7 | | | | | | | — | 0.101 |
| 8 | 9.9 | 4.3 | — | 0.16 | 1.0 | 0.15 | $T_5$ | 0.042 |
| 9 | | | | | | | $T_7$ | 0.028 |
| 10 | | | | | | | — | 0.087 |
| 11 | 8.6 | 3.4 | 0.46 | 0.16 | 0.94 | 0.15 | $T_5$ | 0.007 |
| 12 | | | | | | | $T_7$ | −0.004 |

Note:
Negative sign designates a decrease of the dimension.

In the Table 3, it will be noted that, in the test pieces of the aforementioned configuration, the magnesium content also has an effect of suppressing the growth of the material and such effect is significant particularly when the samples are applied with heat treatment such as $T_5$ or $T_7$ treatment.

The invention has thus been shown and described with reference to specific examples, however, it should be noted that the invention is in no way limited to such examples but changes and modifications may be made within the scope of the appended claims.

We claim:

1. Method for manufacturing an engine cylinder block comprising the steps of moulding an aluminum alloy consisting essentially of in weight between about 4 to 14% of Si, 1 to 5% of Cu and 0.2 to 0.8% of Mg to form a blank of the cylinder block and subjecting the moulded blank to a heat treatment at between about 200° to 400° C. for between about 1 to 10 hours, followed by air cooling the blank.

2. Method for manufacturing an engine cylinder block comprising the steps of moulding an aluminum alloy consisting essentially of in weight between about 4 to 14% of Si, 1 to 5% of Cu and 0.2 to 0.8% of Mg to form a blank of the cylinder block and subjecting the moulded blank to a heat treatment at a temperature of between about 480° to 550° C. for between about 4 to 10 hours, quenching the blank, heating the quenched blank to a temperature between about 200° to 300° C. for between about 2 to 8 hours, and air cooling the heated blank.

3. The method of claim 2 wherein the blank is quenched to between about 15° to 80° C. at a rate between about 3° to 10° C. per second.

4. Method for manufacturing an engine cylinder block comprising the steps of moulding an aluminum alloy consisting essentially of in weight between about 4 to 14% of silicon, 1 to 5% of copper, 0.2 to 0.8% of magnesium, 0.5 to 2.5% of nickel, 0.5 to 2% of manganese, 0.05 to 0.2% of titanium and 1/20 to 1/5 with respect to titanium content of boron to form a blank of a cylinder block, maintaining the blank at a temperature of between about 200° to 400° C. for between about 1 to 10 hours, followed by air cooling the blank.

5. Method for manufacturing an engine cylinder block comprising the steps of moulding an aluminum alloy consisting essentially of in weight about 4 to 14% of silicon, 1 to 5% of copper, 0.2 to 0.8% of magnesium, 0.5 to 2.5% of nickel, 0.5 to 2% of manganese, 0.05 to 0.2% of titanium and 1/20 to 1/5 with respect to titanium content of boron to form a blank of a cylinder block, heating the blank to a temperature of between about 480° to 550° C. for between about 4 to 12 hours, quenching the blank, heating it to a temperature of between about 200° to 300° C. for between about 2 to 8 hours, followed by air cooling the blank.

* * * * *